US007541325B2

(12) United States Patent
Dietrich et al.

(10) Patent No.: US 7,541,325 B2
(45) Date of Patent: Jun. 2, 2009

(54) AGENT FOR REMOVING SOLID PARTICLES

(75) Inventors: Rene Dietrich, Landschlacht (CH); Meinrad Flury, Kerzers (CH)

(73) Assignee: Joker AG, Kerzers (CH)

( * ) Notice: Subject to any disclaimer, the term of this patent is extended or adjusted under 35 U.S.C. 154(b) by 136 days.

(21) Appl. No.: 10/466,862

(22) PCT Filed: Jan. 7, 2002

(86) PCT No.: PCT/CH02/00004

§ 371 (c)(1),
(2), (4) Date: Nov. 3, 2003

(87) PCT Pub. No.: WO02/055642

PCT Pub. Date: Jul. 18, 2002

(65) Prior Publication Data

US 2004/0045094 A1 Mar. 11, 2004

(30) Foreign Application Priority Data

Jan. 11, 2001 (CH) ..... 0037/01

(51) Int. Cl.
*C11D 3/382* (2006.01)

(52) U.S. Cl. ..... 510/462; 510/345; 510/461

(58) Field of Classification Search ..... 604/365; 510/345, 475, 461, 462; 252/542, 548
See application file for complete search history.

(56) References Cited

U.S. PATENT DOCUMENTS

| | | | | |
|---|---|---|---|---|
| 3,903,889 | A * | 9/1975 | Torr | 604/365 |
| 4,654,158 | A * | 3/1987 | Shepherd, Jr. | 510/158 |
| 6,336,977 | B1 * | 1/2002 | Menke et al. | 134/42 |
| 6,342,472 | B1 * | 1/2002 | Legel et al. | 510/345 |

FOREIGN PATENT DOCUMENTS

| | | |
|---|---|---|
| WO | WO98/46712 | * 10/1998 |
| WO | WO 99/06512 | 2/1999 |

* cited by examiner

*Primary Examiner*—Bernard Lipman
(74) *Attorney, Agent, or Firm*—Victor N. King; Speckman Law Group PLLC; Janet Sleath

(57) ABSTRACT

The invention relates to an agent for removing solid particles form surfaces, containing polymers, surfactants and other constituents. The above-mentioned polymers are naturally polygalactomanans. The agent exists in the form of a gel and runs together or can be mixed together so that the contaminated particles are embedded in the material and new surfaces are formed for receiving other contaminated particles. The invention also relates to the use of agents such as gel cleaners, cold cleaners, neutral cleaners, textile cleaners, disinfectives and/or technical cleaners.

12 Claims, No Drawings

AGENT FOR REMOVING SOLID PARTICLES

BACKGROUND OF THE INVENTION

The present invention relates to an agent for removing solid particles from surfaces, its manufacture and use. The agent in particular is suitable for cleaning difficultly accessible and/or sensitive surfaces and for the fluff-free removal of solid particles.

Conventional chemical cleaning agents for hard surfaces are offered as liquid or foam-like (also in spray form), pasty or solid cleaners. So-called microemulsions are also applied for washing and cleaning processes. From these cleaners it is expected that they display an optimal application profile in the concentrated condition as well as in a diluted, aqueous or organic solution, in combination with mechanical energy and a mechanical cleaning means, for example a sponge or cloth.

The use of cleaning cloths or cleaning tissues in practise may not be effected without fluff. On the one hand fibers or fiber parts of the tissue or fabric of the cloth and tissue are released. On the other hand also dirt fibers which have been accommodated by the cleaning cloth or cleaning fabric are released since these do not adhere sufficiently. In pure space conditions this again and again leads to problems, and to little acceptance of these products.

The mentioned chemical and mechanical cleaning agents are very suitable for smooth, relatively insensitive surfaces. They are however not so suitable if difficultly accessible surfaces, such as car dashboards or keyboards of telephones, mobile telephones and computers are to be cleaned. The various liquid cleaners obtainable on the market although being able to be sprayed or deposited on these without any problem, their removal together with the dirt particles for example out of the intermediate spaces of a computer keyboard or a car dashboard must however be effected with mechanical means such as tissues, sponges or paper, a procedure which with the described difficultly accessible surfaces has been shown to be almost impossible. Furthermore there exists the danger that the liquid or foam cleaner or cleaning agent flows onto sensitive electronics parts and leads to damage. As a result of the drying of the solvent, residues of dust and cleaning agent form between the computer buttons or in the interstices of dashboards, which then are even more awkward to remove and in time attack the surfaces which were supposed to be cleaned.

Screens, for example of television apparatus and computers react very sensitively to mechanical cleaning. On account of the depositing and rubbing or wiping of the conventional cleaning agent in combination with the dust particles there often occurs fine scratches of the surfaces which compromises the picture quality. If the screens are cleaned in a "dry" manner, i.e. only mechanically with a cloth and without a liquid agent, the apparatus are often statically charged which may lead to very slight electric shocks which are however unpleasant.

A further disadvantage of the conventional chemical cleaning agents is their ecological compatibility. Although conforming to the regulations of laws throughout Europe with respect to washing and cleaning agents with regard to their biological degradability, the quantities of surfactants, acids and alkalines which get into the waste water system and must be broken down here is relatively large. With the mechanical means such as the above described cloths for screens or optical apparatus, it must further be mentioned that they may only be used once and then usually need to be disposed of. The same applies to adhesive rollers which are widely used as "fluff rollers". After a short period of use the adhesive surfaces are completely covered with hair, fluff and other dirt particles. The cleaning effect is virtually lost and the surface section of the adhesive roller must be disposed of.

BRIEF SUMMARY OF THE INVENTION

It is the object of the invention to provide a cleaning agent which is capable of removing solid particles from difficultly accessible surfaces which at the same time may be easily applied and is ecologically compatible and may be used over a longer period of time with a sustained high cleaning effect.

The cleaning agent of the present invention should furthermore permit a gentle mechanical cleaning of surfaces of sensitive materials such as glass, ceramic, wood, various plastics and metals, and be applicable as a gel cleaner, cold cleaner, neutral cleaner, disinfection cleaner and technical cleaner. According to the consistency, the means is also suitable for removing threads of dust, hair and similar matter from textiles.

The various objects of the present invention are achieved by the manufacture of a gel-like cleaning agent based on natural polysaccharides and chemically modified polysaccharides, in particular polygalactomanans or synthetic polymers. The agent is formulated in a manner such that a soft, easily deformable mass results which adapts to every contour, at the same time is cohesive so that small gaps and cavities are reached without however leaving residues when it is removed from the surface to be cleaned.

By way of dabbing, laying or pressing, the dust particles, grease or other contamination are accommodated by the surface of the cleaning agent by way of cohesion, i.e. a mechanical (physical) cleaning takes place, but without chaffing or rubbing etc. Since the mass of the cleaning agent is gel-like and runs together, i.e. can be mixed together, the dirt particles are embedded into the mass and new surfaces are formed which may accommodate further dirt particles.

Depending on the acting time the cleaning mass also acts such that it releases dirt and/or fat. With a simple dabbing-off however the acting time may be too small in order to release contamination or grease rigidly adhering to the surface to be cleaned.

Due to its consistency, its constitution and its chemical structure the cleaning agent according to application and requirement may be cut up or reduced in size and may also "grow together" again. A syneresis, i.e. an "ageing" of the mass due to drying-out and/or water precipitation hardly occurs since the solvents and cleaning fluids are present bound in a structure gel.

By way of accommodating dirt particles the color of the cleaning agent changes for example from an intensively shining yellow to a greenish-yellow color tone, which is an indicator for the contamination of the mass with dirt.

Due to its special composition the cleaning agent of the present invention acts in a degreasing and disinfecting manner (bactericide, viricide and fungicide). It has low or no flammability, it is environment-friendly, skin-compatible and antistatic and does not stick. Since it is mildly alkaline, it neither causes corrosion nor does it lead to rusting of the cleaned surfaces.

EXAMPLE

With the cleaning agent according to the invention it is the case of a gel-like mass with a particularly slow-flowing cohesive consistency, which releases the smallest solid particles such as dust and pollen from a surfaces and bonds these.

As a base substance for the gel-like cleaning agent of the present invention with particularly slow flow behaviour one uses polygalactomanans such as guar seed flour and/or carob seed flour. Guar flour is obtained by milling the endosperm of the guar bean belonging to the family Leguminosae. The main component of guar flour is guar gum which is, as indicated above, a polygalactomanan or polysaccharide respectively. As a natural thickening agent guar flour is widely used as a stabilizing agent and thickener in the field of foodstuffs, in the textile industry and in the explosives sector.

Carob seed flour is obtained from the seeds located in the pods of the carob tree, whose endosperm consist of up to 90% of high-molecular galactomanan. The field of application of carob seed flour is likewise in the foodstuff industry, but also in the tobacco and paper industries. Guar seed flour as well as carob seed flour are obtainable on the market.

For manufacturing the cleaning agent of the present invention, according to the solvent used, one preferably applies chemically and/or physically modified guar seed flour. With this it is the case of carboxymethylised, alkylised or hydroxyalkylised galactomanans or hydoxyalkylised cationic derivatives. Guar products which are etherised with quaternary ammonium compounds or have been oxidatively or hydrolytically depolymerised may likewise be applied.

On manufacture of gel-like cleaning agents according to the invention with a particularly slow flow behaviour one however uses cationically modified guar flour and/or carob flour which for example has been obtained by the addition of boron ions to the galactomanans.

Gels with a similar flow behaviour may also be obtained by the addition of a complex-forming substances to synthetic hydrocolloid solutions such as for example polyvinyl alcohol solution, for example by reaction of polyvinyl alcohol with boric acid on the one hand and boric acid salts on the other hand, with pH-shifting into the alkaline (polyvinyl alcohol boric acid didiol complex) and the addition of a suitable softener such as ethylene glycol, di- and triethylene glycol, PEG, glycerine.

A large constituent part of the cleaning agent, i.e. 70 to 97%, preferably 90 to 95% of the mass consists of a bonded water and organic solvent. The mass has a good compatibility with electrolytes, glycol and alcohol. Saturated, monovalent alcohols such as methyl alcohol, ethyl alcohol, isopropyl alcohol or mixtures thereof are preferred.

The mass of the cleaning agent has a good compatibility with wash-active substances. Water-soluble, hydrolysis-stable surfactants which additionally to their cleaning effect also contribute to the improvement of the slidability of the mass and for preventing adhesion and which also act as an antistatic agent are applied. One preferably applies surfactants with the chemical base structure polydimethyl siloxane polyoxyalkylene, copolymers and/or nonionogenic surfactants such as polysiloxane polyether copolymers.

The addition of suitable preservatives offers a wide spectrum of anti-bacterial effect from gram-negative and gram-positive bacteria and protection from mould fungus and viruses. Such commercially available products may for example have the following substances or mixtures thereof: esters of p-hydroxybenzoic acid, imidazolidine urea, diiodomethyl sulfonyltoluol.

The addition of fragrances is desirable.

The viscosity measured at 25° C. according to the application of the gel-like cleaning agent is 50,000 to 150,000 mPa·s, preferably between 80,000 and 120,000 and mostly preferred 100,000 mPa·s.

One cleaning agent according to the invention accordingly for example consists of a water/alcohol mixture with a content of 0.1 to 6 percent by weight of glactomanan and 0.01 to 0.5% of boron with a pH-value of 6-10. As boron components sodium tetra borate (borax) and boric acid are suitable for cross linking. Disinfectants, colorants, preservatives, surfactants, aromatics are added to the cleaner in suitable quantities, adapted to the demanded profile of the cleaner. The pH value when required may be set by way of the addition of phosphates, for example trisodium phosphate and soda.

The cleaning agent according to the invention according to the above used application is a combination of chemical and mechanical cleaning agents, preferably however comprises both types of cleaners without having their disadvantages. The completely new consistency opens up fields of application which until now could not even be accomplished satisfactorily by a combination of existing cleaners. The new cleaner is ready for use at any time and need not be mixed or prepared in any other manner. One requires no type of mechanical cleaning utensils in order to use the cleaner according to the invention. The cleaner is preferably supplied in portion containers which simultaneously provide the user with storage when not in use.

The invention claimed is:

1. An agent for removing solid particles from surfaces, comprising:

(a) surfactants; and (b) modified guar seed flour that has been carboxymethylized, alkylated, etherized with quaternary ammonium compounds, oxidatively or hydrolytically depolymerized, or cationically modified or cross-linked by the addition of boron ions, wherein the agent has a viscosity of from 80,000 to 150,000 mPa·s at 25° C., wherein between about 70% to 97% of the mass of the agent comprises bound water and solvent, wherein the solvent is a saturated, monovalent alcohol selected from the group consisting of methyl alcohol, ethyl alcohol, isopropyl alcohol, and mixtures thereot and wherein the mixture of water and solvent has a pH value between 6 and 10.

2. The agent of claim 1, wherein the agent has a viscosity of 100,000 mPa·s.

3. The agent of claim 1, wherein about 95% of the mass of the agent consists of bound water and solvent.

4. The agent of claim 1, wherein the surfactants are selected from the group consisting of: water-soluble, hydrolysis-stable surfactants of the chemical structure of polydimethyl siloxane polyoxyalkylene copolymers and non-ionogenic surfactants of the chemical structure of polysiloxane polyether copolymers.

5. The agent of claim 1, further comprising an ingredient selected from the group consisting of: fungicidal, bactericidal and viricidal agents, colorants, preservatives, and combinations thereof.

6. The agent of claim 1, wherein the agent comprises a water/alcohol mixture containing 0.1 to 6 percent by weight of galactomanan, and wherein the mixture additionally comprises 0.01 to 0.5% boron and has a pH value of 6 to 10.

7. The agent of claim 1, wherein the agent has a gel-like consistency and runs together to incorporate dirt particles into the mass and expose new surfaces for further accommodation of dirt particles.

8. A method for manufacturing agents according to claim 1, comprising contacting a solution or dispersion of polymers with water-soluble, hydrolysis-stable surfactants and adjusting the solution or dispersion to a pH of 6 to 10.

9. The agent of claim 1, wherein the agent can be provided as a cleaner selected from the group consisting of gel-cleaners, cold cleaners, neutral cleaners, textile cleaners, disinfectant cleaners, technical cleaners, and combinations thereof.

10. An agent for removing solid particles from surfaces, comprising:

(a) surfactants; and (b) carob seed flour, wherein the agent has a viscosity of from 80,000 to 150,000mPa·s at 25° C., wherein between about 70% to 97% of the mass of the agent comprises bound water and solvent, wherein the solvent is a saturated, monovalent alcohol selected from the group consisting of methyl alcohol, ethyl alcohol, isopropyl alcohol, and mixtures thereof, and wherein the mixture of water and solvent has a pH value between 6 and 10.

11. The agent of claim 10, wherein the carob seed flour is chemically and/or physically modified.

12. The agent of claim 10, wherein the carob seed flour is cationically modified or cross-linked by the addition of boron ions.

* * * * *